US008726447B2

(12) United States Patent
Paciullo

(10) Patent No.: US 8,726,447 B2
(45) Date of Patent: May 20, 2014

(54) TOOTHBRUSH HAVING IMPROVED TUFT RETENTION AND ANCHOR WIRE

(71) Applicant: Colgate-Palmolive Company, New York, NY (US)

(72) Inventor: Francis Patrick Paciullo, Whitehouse Station, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 13/799,712

(22) Filed: Mar. 13, 2013

(65) Prior Publication Data

US 2013/0192012 A1 Aug. 1, 2013

Related U.S. Application Data

(62) Division of application No. 12/496,380, filed on Jul. 1, 2009, now Pat. No. 8,402,591.

(51) Int. Cl.
*A46B 3/16* (2006.01)

(52) U.S. Cl.
USPC ..... 15/167.1; 15/190; 15/195; 15/205

(58) Field of Classification Search
USPC ..... 15/190, 191.1, 195, 205, 167.1
See application file for complete search history.

(56) References Cited

U.S. PATENT DOCUMENTS

| | | | |
|---|---|---|---|
| 447,996 | A | 3/1891 | Young |
| 503,795 | A | 8/1893 | Kimball |
| 725,269 | A | 4/1903 | Möbius |
| 730,497 | A | 6/1903 | Wallach |
| 788,714 | A | 5/1905 | Flemming |
| 1,070,860 | A | 8/1913 | Vanderveld |
| 1,601,217 | A | 9/1926 | Jones |
| 1,828,422 | A | 10/1931 | Levy |
| 1,919,010 | A | 7/1933 | Connor |
| 1,936,743 | A | 11/1933 | Zahoransky |
| 1,957,363 | A | 5/1934 | Snell |
| 1,972,691 | A | 9/1934 | Nishio |
| 2,303,470 | A | 1/1942 | Jobst |
| 2,289,316 | A | 7/1942 | Cave |
| 2,409,490 | A | 5/1944 | Jobst |
| 2,397,471 | A | 4/1946 | Cox |
| 2,686,495 | A | 8/1954 | Hutton |

(Continued)

FOREIGN PATENT DOCUMENTS

| | | |
|---|---|---|
| AU | 652769 | 2/1992 |
| AU | 718687 | 1/1998 |

(Continued)

*Primary Examiner* — Randall Chin
(74) *Attorney, Agent, or Firm* — Ryan M. Flandro

(57) ABSTRACT

An ansate implement, especially a toothbrush, having improved tuft retention and a staple for use therewith. The staple has a specially designed topography that provides reliable anchoring and creation from cost effective materials. In one embodiment, the invention is an ansate implement comprising: a handle; a head connected to said handle and having at least one hole extending into the head from a surface; at least one cleaning element positioned in the hole; and a staple located in the hole anchoring the cleaning element in the tuft hole, the staple having a longitudinal axis and a first major surface, wherein a plurality of spaced apart grooves are formed into the first major surface, each of the grooves extending along a linear axis from a bottom edge of the staple toward a top edge of the staple, the linear axis intersecting the longitudinal axis at an acute angle of 40 to 70 degrees.

4 Claims, 17 Drawing Sheets

(56) References Cited

U.S. PATENT DOCUMENTS

| | | | |
|---|---|---|---|
| 2,896,285 | A | 7/1959 | Morin |
| 3,277,510 | A | 10/1966 | Peloquin |
| 4,475,261 | A | 10/1984 | Okumura et al. |
| 5,045,091 | A | 9/1991 | Abrahamson et al. |
| 5,303,539 | A | 4/1994 | Neamtu |
| 5,483,723 | A | 1/1996 | Wenzer |
| 5,724,697 | A | 3/1998 | Klee et al. |
| 5,740,579 | A | 4/1998 | Fassler |
| 6,009,589 | A | 1/2000 | Driesen et al. |
| 6,101,659 | A | 8/2000 | Halm |
| 6,138,689 | A | 10/2000 | Stern |
| 6,161,243 | A | 12/2000 | Weihrauch |
| 6,308,367 | B1 | 10/2001 | Beals et al. |
| 6,315,556 | B1 | 11/2001 | Stewart |
| 6,327,735 | B1 | 12/2001 | Kramer |
| 6,665,901 | B2 | 12/2003 | Driesen et al. |
| 7,272,923 | B2 | 9/2007 | Lee |
| 2004/0187244 | A1 | 9/2004 | Giertz |
| 2006/0039779 | A1 | 2/2006 | Ringl |

FOREIGN PATENT DOCUMENTS

| | | |
|---|---|---|
| AU | 2004277995 | 4/2005 |
| BR | 9103498 | 5/1992 |
| CN | 1203516 | 12/1998 |
| CN | 2634900 | 8/2004 |
| CN | 1671315 | 9/2005 |
| CN | 1897844 | 1/2007 |
| CN | 2933129 Y | 8/2007 |
| CZ | 283325 | 8/1997 |
| CZ | 286851 | 12/1997 |
| CZ | 289389 | 6/1998 |
| CZ | 293224 | 7/1998 |
| CZ | 293223 | 10/1998 |
| CZ | 292799 | 3/1999 |
| CZ | 293294 | 8/1999 |
| CZ | 293855 | 8/1999 |
| CZ | 295399 | 6/2000 |
| CZ | 296913 | 3/2001 |
| CZ | 296914 | 3/2001 |
| CZ | 295811 | 6/2002 |
| CZ | 292101 | 2/2003 |
| CZ | 292781 | 4/2003 |
| CZ | 13961 | 1/2004 |
| CZ | 15723 | 8/2005 |
| CZ | 16024 | 11/2005 |
| CZ | 16442 | 4/2006 |
| CZ | 16443 | 4/2006 |
| CZ | 18122 | 12/2007 |
| CZ | 298641 | 12/2007 |
| DE | 19519291 | 11/1996 |
| EP | 953304 | 3/1999 |
| EP | 840561 | 5/2002 |
| GB | 5143 | 0/1911 |
| GB | 2336769 | 3/1999 |
| JP | 2004081286 | 3/2004 |
| RU | 2145480 | 2/2000 |
| SU | 454754 | 2/1975 |
| WO | WO9746136 | 12/1997 |
| WO | WO9800048 | 1/1998 |
| ZA | 96/9960 | 11/1996 |
| ZA | 96/4994 | 2/1997 |
| ZA | 98/1249 | 2/1998 |

| (Toothbrush) | Toothbrush 1 | (Material) | | F401:J340=2:1 |
|---|---|---|---|---|
| (Bristle) | Nylon 610 | (Anchor Type) M# | | M01380 Ag-Ni w/ Longitudinal Groove |
| (Instrument) | (Motorised Auto Tuft Retention Tester)--30.5cm/min | | | |
| (Criteria) | get>=1.33 | | | |

| test point TR No. (kgf) | T | N | M1 | M2 | M3 | Anchor Length | Count(T) |
|---|---|---|---|---|---|---|---|
| 1 | 2.6 | 2.8 | 3.2 | 3.4 | 3.4 | 2.07 | 16 |
| 2 | 3.8 | 3.4 | 3.6 | 3.8 | 3.8 | 2.06 | 15 |
| 3 | 3.0 | 3.4 | 3.8 | 3.8 | 4.2 | 2.06 | 16 |
| 4 | 3.4 | 4.0 | 3.8 | 3.6 | 4.0 | 2.07 | 15 |
| 5 | 4.0 | 3.8 | 3.6 | 3.6 | 3.8 | 2.10 | 17 |
| 6 | 3.6 | 3.4 | 3.6 | 3.6 | 3.8 | 2.08 | 16 |
| 7 | 3.8 | 4.0 | 3.8 | 3.6 | 4.0 | 2.06 | 18 |
| 8 | 3.8 | 4.4 | 4.0 | 4.2 | 4.0 | 2.08 | 18 |
| 9 | 3.2 | 3.0 | 3.5 | 3.8 | 3.4 | 2.10 | 16 |
| 10 | 3.4 | 2.8 | 2.8 | 2.8 | 3.6 | 2.07 | 16 |
| 11 | 3.6 | 3.4 | 3.8 | 4.2 | 4.0 | 2.11 | 16 |
| 12 | 3.4 | 3.6 | 3.0 | 3.5 | 3.8 | 2.08 | 16 |
| 13 | 4.2 | 3.6 | 3.6 | 4.0 | 3.8 | 2.09 | 17 |
| 14 | 3.4 | 3.0 | 3.8 | 3.6 | 3.5 | 2.08 | 16 |
| 15 | 3.3 | 3.6 | 3.4 | 3.6 | 3.6 | 2.09 | 15 |
| 16 | 4.2 | 3.6 | 4.4 | 4.2 | 3.8 | 2.09 | 17 |
| 17 | 3.6 | 3.2 | 4.0 | 3.4 | 4.0 | 2.09 | 16 |
| 18 | 3.8 | 4.0 | 4.4 | 4.0 | 4.0 | 2.08 | 17 |
| 19 | 4.0 | 3.8 | 3.8 | 3.6 | 4.6 | 2.09 | 17 |
| 20 | 4.0 | 3.8 | 4.4 | 4.6 | 3.6 | 2.08 | 16 |
| 21 | 3.8 | 4.6 | 4.6 | 4.0 | 4.4 | 2.11 | 17 |
| 22 | 3.2 | 3.0 | 3.5 | 4.0 | 3.6 | 2.07 | 15 |
| 23 | 4.2 | 3.0 | 3.2 | 3.8 | 3.6 | 2.10 | 16 |
| 24 | 3.6 | 3.0 | 3.6 | 3.0 | 3.0 | 2.10 | 17 |
| 25 | 4.0 | 4.0 | 3.6 | 4.6 | 4.2 | 2.09 | 16 |
| 26 | 3.4 | 3.6 | 3.6 | 4.2 | 4.2 | 2.08 | 17 |
| 27 | 3.6 | 3.2 | 3.8 | 4.0 | 4.0 | 2.09 | 18 |
| 28 | 3.8 | 3.6 | 3.6 | 3.6 | 3.8 | 2.08 | 17 |
| 29 | 4.0 | 4.0 | 3.6 | 4.2 | 3.2 | 2.08 | 17 |
| 30 | 3.8 | 3.2 | 3.8 | 3.6 | 3.8 | 2.10 | 16 |
| Maximum | 4.2 | 3.8 | 4.6 | 4.6 | 4.6 | | |
| Minimum | 2.6 | 3.2 | 2.8 | 2.8 | 3.0 | | |
| Average | 3.7 | | | | | | |
| Cpk | 1.50 | | | | | | |

FIGURE 10A

Process Capability Analysis for Toothbrush 1

| Process Data | |
|---|---|
| USL | * |
| Target | * |
| LSL | 2.00000 |
| Mean | 3.69933 |
| Sample N | 150 |
| StDev (Within) | 0.377219 |
| StDev (Overall) | 0.406097 |

| Potential (Within) Capability | |
|---|---|
| Cp | * |
| CPU | * |
| CPL | 1.50 |
| Cpk | 1.50 |
| Cpm | * |

| Overall Capability | | Observed Performance | | Exp. "Within" Performance | | Exp. "Overall" Performance | |
|---|---|---|---|---|---|---|---|
| Pp | * | | | | | | |
| PPU | * | PPM < LSL | 0.00 | PPM < LSL | 3.32 | PPM < LSL | 14.29 |
| PPL | 1.39 | PPM > USL | * | PPM > USL | * | PPM > USL | * |
| Ppk | 1.39 | PPM Total | 0.00 | PPM Total | 3.32 | PPM Total | 14.29 |

| (Toothbrush) | | Toothbrush 1 | | (Material) | | | F401:J340=2:1 |
|---|---|---|---|---|---|---|---|
| (Bristle) | | Nylon 610 | | (Anchor Type) M# | | | Brass Staple w/ 60 Degree Angled Grooves |
| (Instrument) | | (Motorised Auto Tuft Retention Tester)--30.5cm/min | | | | | |
| (Criteria) | | TR〉 =2.0kgf,Target>=3.4kgf;CPK>1.0,Target>=1.33 | | | | | |
| test point TR No. (kgf) | T | N | M1 | M2 | M3 | Anchor Length | Count(T) |
| 1 | 3.2 | 3.7 | 3.2 | 3.8 | 4.2 | 2.12 | 18 |
| 2 | 3.5 | 3.6 | 4.4 | 3.6 | 3.4 | 2.12 | 18 |
| 3 | 3.0 | 3.6 | 3.8 | 3.6 | 4.6 | 2.12 | 18 |
| 4 | 3.4 | 4.4 | 4.0 | 4.2 | 4.2 | 2.11 | 18 |
| 5 | 3.6 | 3.2 | 4.0 | 3.2 | 3.8 | 2.12 | 18 |
| 6 | 4.2 | 3.4 | 3.6 | 4.4 | 3.8 | 2.11 | 18 |
| 7 | 3.6 | 3.8 | 3.8 | 4.0 | 4.6 | 2.11 | 18 |
| 8 | 3.6 | 3.8 | 3.5 | 4.4 | 4.0 | 2.12 | 18 |
| 9 | 3.2 | 4.2 | 3.8 | 3.6 | 4.0 | 2.12 | 18 |
| 10 | 3.0 | 3.2 | 4.0 | 3.4 | 4.0 | 2.12 | 16 |
| 11 | 3.6 | 3.5 | 3.8 | 4.0 | 3.7 | 2.11 | 17 |
| 12 | 3.7 | 4.2 | 3.8 | 4.0 | 4.0 | 2.12 | 17 |
| 13 | 3.8 | 3.8 | 3.2 | 3.4 | 3.8 | 2.11 | 19 |
| 14 | 3.2 | 3.2 | 3.8 | 4.0 | 3.8 | 2.11 | 18 |
| 15 | 3.4 | 3.7 | 3.8 | 3.6 | 3.6 | 2.12 | 18 |
| 16 | 3.4 | 4.0 | 3.8 | 3.6 | 3.4 | 2.12 | 18 |
| 17 | 3.0 | 4.0 | 3.6 | 3.6 | 4.4 | 2.11 | 17 |
| 18 | 4.0 | 3.8 | 3.6 | 4.0 | 3.7 | 2.11 | 18 |
| 19 | 3.4 | 3.4 | 4.0 | 4.0 | 3.6 | 2.10 | 18 |
| 20 | 3.0 | 3.8 | 3.6 | 3.8 | 4.0 | 2.11 | 17 |
| 21 | 3.6 | 3.8 | 3.4 | 3.5 | 4.1 | 2.12 | 18 |
| 22 | 3.4 | 4.2 | 3.4 | 4.2 | 3.8 | 2.12 | 17 |
| 23 | 4.2 | 3.6 | 4.2 | 3.8 | 3.8 | 2.10 | 18 |
| 24 | 3.6 | 4.2 | 4.0 | 3.4 | 3.6 | 2.11 | 18 |
| 25 | 3.6 | 3.6 | 4.0 | 3.6 | 3.8 | 2.12 | 17 |
| 26 | 3.0 | 3.6 | 3.5 | 4.0 | 3.8 | 2.11 | 18 |
| 27 | 3.5 | 3.8 | 3.6 | 3.8 | 4.0 | 2.12 | 18 |
| 28 | 3.0 | 3.8 | 3.8 | 4.2 | 4.0 | 2.11 | 17 |
| 29 | 3.2 | 3.6 | 3.8 | 3.2 | 4.0 | 2.12 | 16 |
| 30 | 3.7 | 4.2 | 3.6 | 3.8 | 4.0 | 2.12 | 17 |
| Maximum | 4.2 | 3.8 | 4.4 | 4.4 | 4.6 | | |
| Minimum | 3.0 | 3.2 | 3.2 | 3.2 | 3.4 | | |
| Average | 3.7 | | | | | | |
| Cpk | 1.82 | | | | | | |

FIGURE 11A

Process Capability Analysis for Toothbrush 1

| **Process Data** | |
|---|---|
| USL | * |
| Target | * |
| LSL | 2.00000 |
| Mean | 3.73267 |
| Sample N | 150 |
| StDev (Within) | 0.316531 |
| StDev (Overall) | 0.342007 |

| **Potential (Within) Capability** | |
|---|---|
| Cp | * |
| CPU | * |
| CPL | 1.82 |
| Cpk | 1.82 |
| Cpm | * |

| **Overall Capability** | |
|---|---|
| Pp | * |
| PPU | * |
| PPL | 1.69 |
| Ppk | 1.69 |

| **Observed Performance** | |
|---|---|
| PPM < LSL | 0.00 |
| PPM > USL | * |
| PPM Total | 0.00 |

| **Exp. "Within" Performance** | |
|---|---|
| PPM < LSL | 0.02 |
| PPM > USL | * |
| PPM Total | 0.02 |

| **Exp. "Overall" Performance** | |
|---|---|
| PPM < LSL | 0.20 |
| PPM > USL | * |
| PPM Total | 0.20 |

| (Toothbrush) | | Toothbrush 2 | | (Material) | | | F401:J340=1:1 |
|---|---|---|---|---|---|---|---|
| (Bristle) | | Nylon 610 | | (Anchor Type) M# | | | M01380 Ag-Ni Staple w/ Longitudial Groove |
| (Instrument) | | (Motorised Auto Tuft Retention Tester)--30.5cm/min | | | | | |
| (Criteria) | | TR〉 =2.0kgf,Target>=3.4kgf;CPK>1.0,Target>=1.33 | | | | | |
| test point TR No. (kgf) | T | N | M1 | M2 | M3 | Anchor Length | Count(T) |
| 1 | 3.4 | 4.6 | 3.8 | 3.6 | 3.8 | 2.25 | 35 |
| 2 | 3.4 | 5.2 | 4.0 | 3.8 | 4.0 | 2.26 | 36 |
| 3 | 3.5 | 4.4 | 3.6 | 3.8 | 4.0 | 2.27 | 33 |
| 4 | 3.4 | 4.8 | 3.6 | 3.2 | 3.5 | 2.26 | 34 |
| 5 | 3.2 | 4.2 | 3.8 | 4.0 | 4.2 | 2.26 | 36 |
| 6 | 3.0 | 4.6 | 4.2 | 3.6 | 4.2 | 2.25 | 36 |
| 7 | 3.4 | 4.6 | 3.6 | 3.6 | 3.6 | 2.24 | 36 |
| 8 | 3.6 | 4.8 | 4.0 | 4.2 | 3.8 | 2.26 | 36 |
| 9 | 3.2 | 4.4 | 4.2 | 3.8 | 4.0 | 2.25 | 36 |
| 10 | 3.6 | 5.0 | 3.6 | 3.4 | 3.8 | 2.25 | 37 |
| 11 | 3.4 | 4.6 | 4.2 | 3.6 | 3.8 | 2.25 | 37 |
| 12 | 3.8 | 4.4 | 3.6 | 3.5 | 4.0 | 2.26 | 36 |
| 13 | 3.2 | 4.6 | 3.8 | 3.6 | 3.7 | 2.26 | 33 |
| 14 | 3.6 | 4.2 | 3.8 | 4.2 | 3.6 | 2.26 | 35 |
| 15 | 3.4 | 4.4 | 3.8 | 3.6 | 4.0 | 2.27 | 35 |
| 16 | 3.2 | 4.2 | 4.0 | 4.2 | 3.8 | 2.26 | 36 |
| 17 | 3.6 | 4.6 | 4.2 | 3.8 | 3.6 | 2.26 | 36 |
| 18 | 3.6 | 4.8 | 3.8 | 3.8 | 3.6 | 2.26 | 36 |
| 19 | 3.2 | 4.7 | 3.4 | 4.0 | 3.6 | 2.27 | 34 |
| 20 | 3.4 | 4.6 | 4.0 | 3.6 | 3.4 | 2.27 | 36 |
| 21 | 3.4 | 4.0 | 3.6 | 3.2 | 3.8 | 2.26 | 36 |
| 22 | 3.0 | 4.8 | 3.4 | 3.4 | 3.8 | 2.24 | 35 |
| 23 | 3.2 | 4.2 | 3.8 | 3.8 | 3.8 | 2.26 | 36 |
| 24 | 3.0 | 4.2 | 3.6 | 3.5 | 3.6 | 2.26 | 36 |
| 25 | 3.4 | 4.2 | 3.6 | 3.2 | 3.4 | 2.27 | 36 |
| 26 | 3.0 | 4.6 | 3.8 | 3.8 | 4.0 | 2.26 | 35 |
| 27 | 3.3 | 4.4 | 4.6 | 3.4 | 3.6 | 2.26 | 36 |
| 28 | 3.0 | 4.4 | 3.8 | 3.6 | 3.2 | 2.26 | 36 |
| 29 | 3.4 | 4.6 | 3.7 | 3.6 | 4.0 | 2.25 | 36 |
| 30 | 3.4 | 4.0 | 3.8 | 3.8 | 3.6 | 2.25 | 35 |
| Maximum | 3.8 | 3.8 | 4.6 | 4.2 | 4.2 | | |
| Minimum | 3.0 | 3.2 | 3.4 | 3.2 | 3.2 | | |
| Average | 3.8 | | | | | | |
| Cpk | 2.24 | | | | | | |

FIGURE 12A

Process Capability Analysis for Toothbrush 2

| Process Data | |
|---|---|
| USL | * |
| Target | * |
| LSL | 2.00 |
| Mean | 3.82 |
| Sample N | 150 |
| StDev (Within) | 0.271312 |
| StDev (Overall) | 0.458513 |

| Potential (Within) Capability | |
|---|---|
| Cp | * |
| CPU | * |
| CPL | 2.24 |
| Cpk | 2.24 |
| Cpm | * |

| Overall Capability | | Observed Performance | | Exp. "Within" Performance | | Exp. "Overall" Performance | |
|---|---|---|---|---|---|---|---|
| Pp | * | | | | | | |
| PPU | * | PPM < LSL | 0.00 | PPM < LSL | 0.00 | PPM < LSL | 36.03 |
| PPL | 1.32 | PPM > USL | * | PPM > USL | * | PPM > USL | * |
| Ppk | 1.32 | PPM Total | 0.00 | PPM Total | 0.00 | PPM Total | 36.03 |

| (Toothbrush) | Toothbrush 2 | (Material) | | F401:J340=1:1 |
|---|---|---|---|---|
| (Bristle) | Nylon 610 | (Anchor Type) M# | | Brass Staple With 60 Degree Angled Grooves |
| (Instrument) | (Motorised Auto Tuft Retention Tester)--30.5cm/min | | | |
| (Criteria) | TR〉 =2.0kgf,Target>=3.4kgf;CPK>1.0,Target>=1.33 | | | |

| test point TR No. (kgf) | T | N | M1 | M2 | M3 | Anchor Length | Count(T) |
|---|---|---|---|---|---|---|---|
| 1 | 4.0 | 5.0 | 4.2 | 4.4 | 4.4 | 2.26 | 35 |
| 2 | 3.8 | 4.6 | 3.6 | 3.8 | 4.2 | 2.27 | 36 |
| 3 | 3.2 | 5.0 | 3.6 | 4.2 | 4.5 | 2.27 | 36 |
| 4 | 4.4 | 4.6 | 4.0 | 4.0 | 4.2 | 2.26 | 37 |
| 5 | 4.0 | 4.6 | 4.0 | 4.2 | 4.8 | 2.27 | 36 |
| 6 | 3.8 | 5.0 | 3.8 | 4.2 | 4.2 | 2.27 | 35 |
| 7 | 3.8 | 4.0 | 3.8 | 3.6 | 4.2 | 2.28 | 36 |
| 8 | 3.8 | 4.8 | 4.0 | 4.4 | 4.3 | 2.27 | 37 |
| 9 | 3.8 | 4.2 | 4.0 | 3.6 | 4.4 | 2.28 | 37 |
| 10 | 4.0 | 4.4 | 4.0 | 3.6 | 4.2 | 2.26 | 37 |
| 11 | 3.6 | 4.8 | 4.2 | 4.0 | 4.2 | 2.28 | 36 |
| 12 | 4.0 | 4.4 | 4.0 | 4.4 | 4.2 | 2.26 | 36 |
| 13 | 3.4 | 4.6 | 3.8 | 4.2 | 4.0 | 2.28 | 36 |
| 14 | 4.0 | 4.6 | 4.2 | 4.0 | 4.2 | 2.26 | 37 |
| 15 | 4.0 | 4.0 | 3.8 | 3.6 | 3.6 | 2.26 | 36 |
| 16 | 3.6 | 4.6 | 3.8 | 3.6 | 4.0 | 2.26 | 36 |
| 17 | 4.2 | 4.6 | 4.2 | 3.8 | 4.0 | 2.27 | 36 |
| 18 | 3.4 | 4.2 | 3.8 | 3.8 | 4.2 | 2.26 | 35 |
| 19 | 4.4 | 4.4 | 3.8 | 4.0 | 4.0 | 2.26 | 36 |
| 20 | 3.4 | 4.6 | 3.8 | 4.1 | 4.0 | 2.26 | 36 |
| 21 | 3.4 | 4.6 | 4.0 | 4.2 | 4.0 | 2.26 | 37 |
| 22 | 3.6 | 4.3 | 3.6 | 3.6 | 3.6 | 2.26 | 36 |
| 23 | 3.8 | 4.4 | 4.2 | 3.8 | 4.2 | 2.27 | 36 |
| 24 | 4.0 | 4.6 | 4.0 | 4.4 | 4.0 | 2.28 | 36 |
| 25 | 3.6 | 4.0 | 3.6 | 3.8 | 4.0 | 2.26 | 36 |
| 26 | 3.4 | 4.6 | 3.8 | 3.6 | 3.8 | 2.27 | 36 |
| 27 | 3.8 | 4.3 | 4.2 | 3.8 | 4.0 | 2.28 | 37 |
| 28 | 4.0 | 4.6 | 3.8 | 3.4 | 4.0 | 2.28 | 36 |
| 29 | 3.6 | 4.0 | 3.8 | 3.6 | 4.2 | 2.26 | 36 |
| 30 | 3.8 | 4.4 | 4.0 | 4.0 | 3.6 | 2.27 | 37 |
| Maximum | 4.4 | 3.8 | 4.2 | 4.4 | 4.8 | | |
| Minimum | 3.2 | 3.2 | 3.6 | 3.4 | 3.6 | | |
| Average | 4.0 | | | | | | |
| Cpk | 2.48 | | | | | | |

FIGURE 13A

Process Capability Analysis for Toothbrush 2

| Process Data | |
|---|---|
| USL | * |
| Target | * |
| LSL | 2.00000 |
| Mean | 4.04467 |
| Sample N | 150 |
| StDev (Within) | 0.274882 |
| StDev (Overall) | 0.363213 |

| Potential (Within) Capability | |
|---|---|
| Cp | * |
| CPU | * |
| CPL | 2.48 |
| Cpk | 2.48 |
| Cpm | * |

| Overall Capability | | Observed Performance | | Exp."Within" Performance | | Exp."Overall" Performance | |
|---|---|---|---|---|---|---|---|
| Pp | * | | | | | | |
| PPU | * | PPM < LSL | 0.00 | PPM < LSL | 0.00 | PPM < LSL | 0.01 |
| PPL | 1.88 | PPM > USL | * | PPM > USL | * | PPM > USL | * |
| Ppk | 1.88 | PPM Total | 0.00 | PPM Total | 0.00 | PPM Total | 0.01 |

| (Toothbrush) | | Toothbrush 3 | | (Material) | | | M700R |
|---|---|---|---|---|---|---|---|
| (Bristle) | | Nylon | | (Anchor Type) M# | | | M01380 Ag-Ni Staple w/ Longitudial Groove |
| (Instrument) | | (Motorised Auto Tuft Retention Tester)--30.5cm/min | | | | | |
| (Criteria) | | TR〉 =2.0kgf,Target>=3.4kgf;CPK>1.0,Target>=1.33 | | | | | |
| test point TR No. (kgf) | T | N | M1 | M2 | M3 | Anchor Length | Count(T) |
| 1 | 2.8 | 2.6 | 2.8 | 3.2 | 2.2 | 1.98 | 33 |
| 2 | 2.8 | 2.6 | 2.8 | 2.8 | 2.6 | 1.97 | 32 |
| 3 | 2.8 | 2.6 | 2.2 | 2.8 | 2.2 | 1.98 | 33 |
| 4 | 2.4 | 2.4 | 2.2 | 2.7 | 2.4 | 1.98 | 32 |
| 5 | 2.4 | 2.5 | 2.0 | 2.6 | 2.2 | 1.98 | 32 |
| 6 | 3.0 | 2.4 | 2.0 | 2.4 | 2.2 | 1.97 | 31 |
| 7 | 2.6 | 2.2 | 2.4 | 2.8 | 2.0 | 1.97 | 32 |
| 8 | 3.0 | 2.6 | 2.4 | 2.8 | 2.4 | 1.98 | 32 |
| 9 | 2.6 | 2.4 | 2.2 | 2.6 | 2.2 | 1.98 | 33 |
| 10 | 2.8 | 2.4 | 2.0 | 2.2 | 2.8 | 1.98 | 33 |
| 11 | 2.4 | 2.5 | 2.1 | 2.8 | 2.2 | 1.97 | 33 |
| 12 | 2.6 | 2.2 | 2.6 | 2.8 | 2.0 | 1.97 | 32 |
| 13 | 2.6 | 2.0 | 2.0 | 2.4 | 2.2 | 1.98 | 33 |
| 14 | 2.6 | 2.2 | 2.4 | 2.5 | 2.2 | 1.98 | 32 |
| 15 | 2.5 | 2.0 | 2.0 | 2.4 | 2.0 | 1.97 | 33 |
| 16 | 2.6 | 2.0 | 2.2 | 2.6 | 2.2 | 1.98 | 33 |
| 17 | 2.2 | 2.4 | 2.0 | 2.6 | 2.2 | 1.99 | 31 |
| 18 | 3.0 | 2.6 | 2.6 | 2.6 | 2.0 | 1.98 | 32 |
| 19 | 2.8 | 2.2 | 2.4 | 2.4 | 2.0 | 1.98 | 32 |
| 20 | 2.8 | 2.5 | 2.6 | 2.6 | 2.7 | 1.97 | 33 |
| 21 | 2.6 | 2.2 | 2.1 | 2.2 | 2.8 | 1.98 | 32 |
| 22 | 2.8 | 3.0 | 2.8 | 3.0 | 2.3 | 1.97 | 33 |
| 23 | 2.9 | 2.4 | 2.9 | 2.6 | 2.6 | 1.98 | 33 |
| 24 | 3.0 | 2.0 | 2.2 | 2.4 | 2.2 | 1.98 | 32 |
| 25 | 2.5 | 2.2 | 2.2 | 2.7 | 2.3 | 1.98 | 32 |
| 26 | 3.2 | 2.2 | 2.6 | 3.0 | 2.4 | 1.98 | 33 |
| 27 | 2.6 | 2.4 | 2.5 | 2.8 | 2.4 | 1.97 | 31 |
| 28 | 2.4 | 2.0 | 2.0 | 2.0 | 2.3 | 1.97 | 32 |
| 29 | 2.7 | 2.4 | 2.0 | 2.2 | 2.2 | 1.98 | 32 |
| 30 | 3.0 | 2.2 | 2.0 | 2.6 | 2.0 | 1.98 | 32 |
| Maximum | 3.2 | 3.8 | 2.9 | 3.2 | 2.8 | | |
| Minimum | 2.2 | 3.2 | 2.0 | 2.0 | 2.0 | | |
| Average | 2.4 | | | | | | |
| Cpk | 0.63 | | | | | | |

FIGURE 14A

Process Capability Analysis for Toothbrush 3

Process Data

| | |
|---|---|
| USL | * |
| Target | * |
| LSL | 2.00000 |
| Mean | 2.44667 |
| Sample N | 150 |
| StDev (Within) | 0.236803 |
| StDev (Overall) | 0.303218 |

Potential (Within) Capability

| | |
|---|---|
| Cp | * |
| CPU | * |
| CPL | 0.63 |
| Cpk | 0.63 |
| Cpm | * |

| **Overall Capability** | | **Observed Performance** | | **Exp. "Within" Performance** | | **Exp. "Overall" Performance** | |
|---|---|---|---|---|---|---|---|
| Pp | * | | | | | | |
| PPU | * | PPM < LSL | 0.00 | PPM < LSL | 29631.64 | PPM < LSL | 70363.67 |
| PPL | 0.49 | PPM > USL | * | PPM > USL | * | PPM > USL | * |
| Ppk | 0.49 | PPM Total | 0.00 | PPM Total | 29631.64 | PPM Total | 70363.67 |

| (Toothbrush) | | Toothbrush 3 | | (Material) | | | M700R |
|---|---|---|---|---|---|---|---|
| (Bristle) | | Nylon | | (Anchor Type) M# | | | Brass Staple With 60 Degree Angled Grooves |
| (Instrument) | | (Motorised Auto Tuft Retention Tester)--30.5cm/min | | | | | |
| (Criteria) | | TR〉 =2.0kgf,Target>=3.4kgf;CPK>1.0,Target>=1.33 | | | | | |
| test point TR No. (kgf) | T | N | M1 | M2 | M3 | Anchor Length | Count(T) |
| 1 | 2.8 | 2.6 | 2.6 | 2.7 | 2.4 | 1.98 | 33 |
| 2 | 2.8 | 2.8 | 2.6 | 2.7 | 2.2 | 1.98 | 33 |
| 3 | 2.8 | 2.8 | 2.4 | 2.6 | 2.2 | 1.97 | 33 |
| 4 | 3.4 | 3.2 | 2.8 | 3.0 | 2.8 | 1.97 | 32 |
| 5 | 3.4 | 3.0 | 3.0 | 3.0 | 2.4 | 1.98 | 32 |
| 6 | 3.2 | 2.7 | 2.6 | 2.6 | 2.6 | 1.97 | 33 |
| 7 | 3.0 | 2.6 | 2.4 | 3.0 | 2.6 | 1.97 | 33 |
| 8 | 3.0 | 2.6 | 2.6 | 2.8 | 2.2 | 1.98 | 32 |
| 9 | 3.2 | 2.6 | 2.8 | 3.0 | 2.6 | 1.96 | 33 |
| 10 | 3.0 | 2.4 | 2.6 | 2.6 | 2.4 | 1.98 | 31 |
| 11 | 3.4 | 2.4 | 2.4 | 2.6 | 2.8 | 1.98 | 32 |
| 12 | 2.8 | 2.4 | 2.2 | 2.8 | 2.2 | 1.98 | 33 |
| 13 | 3.4 | 3.0 | 2.6 | 3.0 | 2.8 | 1.97 | 33 |
| 14 | 3.2 | 2.6 | 2.8 | 3.0 | 2.6 | 1.98 | 33 |
| 15 | 3.2 | 2.6 | 3.0 | 3.0 | 2.6 | 1.98 | 33 |
| 16 | 3.4 | 2.2 | 2.4 | 2.6 | 2.2 | 1.97 | 31 |
| 17 | 3.0 | 2.4 | 2.6 | 2.8 | 2.6 | 1.97 | 33 |
| 18 | 3.2 | 2.8 | 3.0 | 3.0 | 2.6 | 1.98 | 33 |
| 19 | 3.6 | 3.4 | 2.4 | 2.8 | 2.8 | 1.98 | 32 |
| 20 | 3.4 | 2.8 | 2.8 | 3.2 | 2.6 | 1.97 | 30 |
| 21 | 3.2 | 2.4 | 2.2 | 2.6 | 2.2 | 1.97 | 32 |
| 22 | 3.0 | 2.4 | 2.6 | 2.6 | 2.6 | 1.98 | 32 |
| 23 | 3.4 | 2.6 | 2.8 | 3.0 | 2.2 | 1.99 | 33 |
| 24 | 3.2 | 2.6 | 2.6 | 3.1 | 2.6 | 1.98 | 33 |
| 25 | 3.2 | 2.5 | 3.0 | 2.8 | 3.0 | 1.97 | 33 |
| 26 | 3.4 | 2.8 | 2.6 | 2.6 | 2.2 | 1.98 | 32 |
| 27 | 3.0 | 2.6 | 2.6 | 2.8 | 2.5 | 1.98 | 33 |
| 28 | 3.5 | 2.5 | 2.7 | 3.0 | 2.2 | 1.98 | 32 |
| 29 | 3.0 | 2.8 | 2.6 | 3.2 | 2.5 | 1.97 | 31 |
| 30 | 3.2 | 2.6 | 3.0 | 2.8 | 2.2 | 1.97 | 33 |
| Maximum | 3.6 | 3.4 | 3.0 | 3.2 | 3.0 | | |
| Minimum | 2.8 | 2.2 | 2.2 | 2.6 | 2.2 | | |
| Average | 2.8 | | | | | | |
| Cpk | 1.09 | | | | | | |

FIGURE 15A

Process Capability Analysis for Toothbrush 3

| Process Data | |
|---|---|
| USL | * |
| Target | * |
| LSL | 2.00 |
| Mean | 2.76 |
| Sample N | 150 |
| StDev (Within) | 0.233233 |
| StDev (Overall) | 0.328858 |

| Potential (Within) Capability | |
|---|---|
| Cp | * |
| CPU | * |
| CPL | 1.09 |
| Cpk | 1.09 |
| Cpm | * |

| Overall Capability | | Observed Performance | | Exp. "Within" Performance | | Exp. "Overall" Performance | |
|---|---|---|---|---|---|---|---|
| Pp | * | | | | | | |
| PPU | * | PPM < LSL | 0.00 | PPM < LSL | 559.94 | PPM < LSL | 10415.64 |
| PPL | 0.77 | PPM > USL | * | PPM > USL | * | PPM > USL | * |
| Ppk | 0.77 | PPM Total | 0.00 | PPM Total | 559.94 | PPM Total | 10415.64 |

TOOTHBRUSH HAVING IMPROVED TUFT RETENTION AND ANCHOR WIRE

CROSS-REFERENCE TO RELATED PATENT APPLICATIONS FIELD OF THE INVENTION

The present application is a divisional of U.S. patent application Ser. No. 12/496,380, filed Jul. 1, 2009 now U.S. Pat. No. 8,402,591, the entirety of which is hereby incorporated by reference.

FIELD OF THE INVENTION

The present invention relates generally to brushes, especially toothbrushes, and specifically to an improved anchor or staple design for securing tufts of bristles within the head of the brush.

BACKGROUND OF THE INVENTION

In the conventional manufacturing process for brushes, particularly toothbrushes, the brushes are injection molded with empty tuft boles in the toothbrush head. The tuft holes may also be drilled after the injection molding as well as initially formed in the head concurrently with the injection molding. In a secondary operation, U shaped tufts of bristles are inserted into the holes in the head. Each tuft of bristles is held in place by a plate-like staple that is wider than the tuft hole so that when the staple is used to drive the U-shaped bristle tufts into the tuft hole, the edges of the staple slightly cut and deform the sides of the hole. The pressure and resulting static friction of the surrounding plastic on the staple contributes to forces maintaining the staple in place. However, there are certain problems associated with brushes made in this manner. Specifically, individual bristles, or even entire tufts of bristles, may occasionally come out of the tuft holes during brushing by a consumer. The staple or anchor art has dealt with these problems in a variety of ways. However, adequately securing tufts of bristles within the tuft holes must be balanced against other considerations, such as costs of materials and the ability to mass manufacture product.

Over the years, toothbrush staples of the rectangular type have become available in which at least one of the major surfaces thereof is provided with parallel horizontal grooves (i.e., grooves that extend parallel with a longitudinal axis of the staple), thereby yielding a staple that has been found to be more resistant to becoming separated from its tuft hole than staples with smooth surfaces.

Staples have also been developed having a rounded edges that eliminate and/or minimize the problem of tuft weakening and possible rupture of filaments or bristles at the bight of the U. With such a rounded construction, the zone or area of contact between the lower staple edge and the bristle filament closely matches the U shape at the bight portion of each tuft. In turn, this permits the staples to be driven deeper into the head and thus a larger and more consistent force can be applied to each U shaped tuft without cutting or damaging the filaments.

More recently, staples having specialized groove patterns on the major surfaces of the staples for improved retention, including a slanted configuration of parallel grooves, have been introduced to the art.

Staples constructed of materials having oligodynamic action have also been disclosed in the art. These oligodynamic staples have smooth major surfaces and are constructed of a material having oligodynamic action, such as cadmium, silver, brass, copper, stainless steel, titanium and mercury.

Typically, toothbrush staples are constructed of a nickel-silver alloy. Due to the costs associated with the nickel-silver alloy, it has long been desired to create staples from cheaper metals, such as brass. While the general concept of using a brass staple has been disclosed, testing and experimentation have proven that merely creating and using a flat-faced brass staple cannot be used in the manufacture of toothbrushes to provide effective tuft retention. Moreover, merely applying known groove patterns has also proven to be ineffective.

SUMMARY OF THE INVENTION

In one aspect, the present invention is a staple having an optimized pattern of grooves in at least one of its major surfaces. The optimized groove pattern makes it possible to create the staples out of a material that is more cost effective than a nickel-silver alloy, such as brass, while still providing the necessary tuft retention so as to be utilized in a viable toothbrush product.

In one such embodiment, the invention can be a toothbrush comprising: a handle; a head connected to said handle and having at least one tuft hole extending into the head from a surface; at least one tuft of bristles positioned in the tuft hole; and a brass staple located in the tuft hole anchoring the tuft of bristles in the tuft hole, the brass staple having a longitudinal axis and a first major surface, wherein a plurality of substantially parallel grooves are formed into the first major surface, each of the grooves extending along a linear axis from a bottom edge of the brass staple to a top edge of the brass staple, the linear axis intersecting the longitudinal axis at an acute angle of 40 to 70 degrees.

In another aspect, the present invention is a staple haying a slanted pattern of grooves formed into both major surfaces of the staple. The slope of the slanted pattern of grooves for each major surface is selected so that the patterns on both of the surfaces act in a complimentary and concerted manner to improve tuft retention.

In one such embodiment, the invention is a toothbrush comprising a handle; a head connected to said handle and having at least one tuft hole extending into the head from a surface; at least one tuft of bristles positioned in the tuft hole; a staple located in the tuft hole anchoring the tuft of bristles in the tuft hole, the staple having a longitudinal axis, a first major surface, and a second major surface; a first set of substantially parallel grooves formed into the first major surface of the staple, each of the grooves in the first set extending along a linear axis from a bottom edge of the staple to a top edge of the staple and slanting upward from a first lateral edge of the staple to a second lateral edge of the staple, the linear axis of the first set of grooves intersecting the longitudinal axis at a first acute angle; and a second set of substantially parallel grooves formed into the second major surface of the staple, each of the grooves in the second set extending along a linear axis from the bottom edge of the staple to the top edge of the staple and slanting upward from the second lateral edge of the staple to the first lateral edge of the staple, the linear axis of the second set of grooves intersecting the longitudinal axis at a second acute angle.

In yet another aspect, the invention is a toothbrush comprising: a handle; a head connected to said handle and having at least one tuft hole extending into the head from a surface; at least one tuft of bristles positioned in the tuft hole; a staple located in the tuft hole anchoring the tuft of bristles in the tuft hole, the staple having a longitudinal axis and a first major surface, wherein a plurality of substantially parallel grooves are formed into the first major surface, each of the grooves extending along a linear axis from a bottom edge of the staple to a top edge of the staple, the linear axis intersecting the longitudinal axis at an acute angle; and each of the grooves having a width and adjacent grooves separated by a distance, wherein the ratio of the distance to the width is between 3.0 and 4.0.

In a still further aspect, the invention can be an ansate implement comprising: a handle; a head connected to said handle and having at least one hole extending into the head from a surface; at least one cleaning element positioned in the hole; and to staple located in the hole anchoring the cleaning element in the tuft hole, the staple having a longitudinal axis and a first major surface wherein a plurality of spaced-apart grooves are formed into the first major surface, each of the grooves extending along a linear axis from a bottom edge of the staple toward a top edge of the staple, the linear axis intersecting the longitudinal axis at an acute angle of 40 to 70 degrees.

In another aspect, the invention can be a staple for securing cleaning elements within an ansate implement, the staple comprising a flat wire having a longitudinal axis and a first major surface, wherein a plurality of spaced-apart grooves are formed into the first major surface, each of the grooves extending along a linear axis from a bottom edge of the flat wire toward a top edge of the flat wire, the linear axis intersecting the longitudinal axis at an acute angle of 40 to 70 degrees.

BRIEF DESCRIPTION OF THE DRAWINGS

FIG. 10A is a table of experimental data for tuft retention for a first toothbrush type using Ag—Ni staples having longitudinal grooves.

FIG. 11A is a table of experimental data for tuft retention for the first toothbrush type using brass staples having angled grooves according to an embodiment of the present invention.

FIG. 12A is a table of experimental data for tuft retention for a second toothbrush type using Ag—Ni staples having longitudinal grooves.

FIG. 13A is a table of experimental data for tuft retention for the second toothbrush type using brass staples having angled grooves according to an embodiment of the present invention.

FIG. 14A is a table of experimental data for tuft retention for a third toothbrush type using Ag—Ni staples having longitudinal grooves.

FIG. 15A is a table of experimental data for tuft retention for the third toothbrush type using brass staples having angled grooves according to an embodiment of the present invention.

DETAILED DESCRIPTION OF THE DRAWINGS

Figure 1:
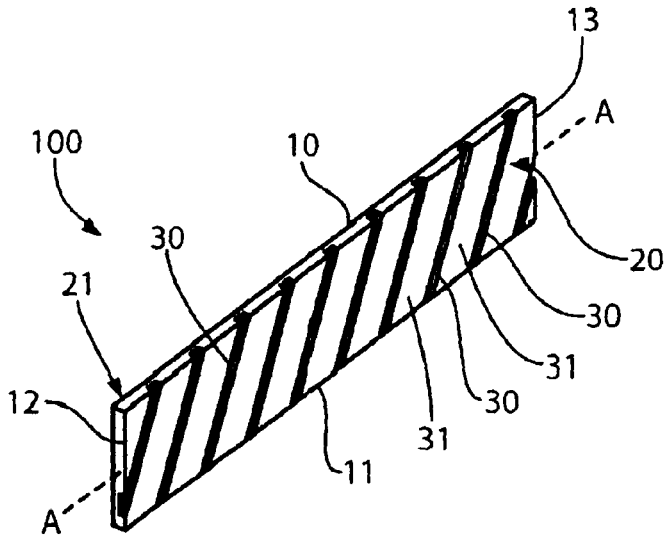
FIG. 1 is a front perspective view of a staple according to a first embodiment of the present invention.
Figure 2:
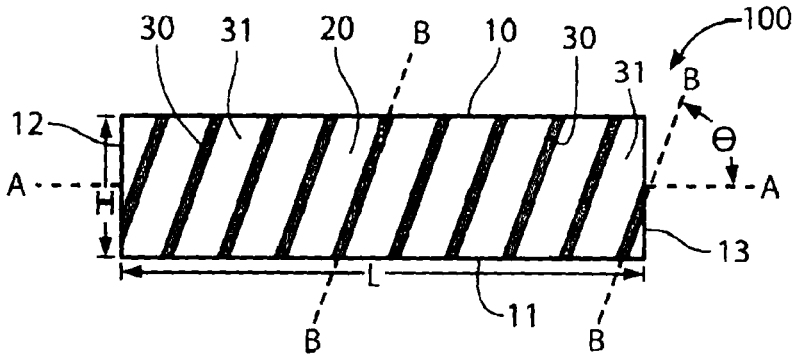
FIG. 2 is a front view of the staple of FIG. 1.
Figure 3:
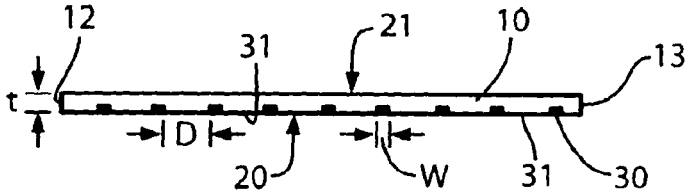
FIG. 3 is a top view of the staple of FIG. 1.

Referring now to FIGS. 1-3 concurrently, a staple 100 is illustrated according to one embodiment of the present invention. The staple 100 is a flattened piece of wire that is used as an anchor in a brush, particularly a toothbrush, to secure U shaped tufts of bristles within tuft holes created in the head of an ansate implement, such as a toothbrush. The staple 100 has a substantially rectangular cross-section (both longitudinal and transverse) and is elongated along the longitudinal axis A-A. Of course, other shapes can be utilized in creating the staple.

The staple 100 is delimited by a perimeter comprising a top edge 10, a bottom edge 11, a first lateral edge 12 and a second lateral edge 13. The staple 100 has a length L, a height H and a thickness t. The length L of the staple 100 will depend on the size of the tuft hole in which it is to be inserted, but is in a preferred range of 2.09 to 2.13 millimeters, and most preferably about 2.11 millimeters far a 1.70 mm tuft hole. The height H of the staple 100 will also depend on the dimensions of its end use, but is in a preferred range of 1.49 to 1.51 millimeters, and most preferably about 1.50 millimeters for a 1.70 mm tuft hole. Similarly, the thickness t of the staple 100 will also depend on its end use, but is in a preferred range of 0.24 to 0.26 millimeters, and most preferably about 0.25 millimeters. The invention, however, is not so limited in all embodiments and other dimensions may be utilized. The exact dimensions in any final product will be dictated by the size of the tuft hole, the type and size of the bristle tufts, the type of brush in which the staples are used, etc. Furthermore, while the staple 100 is illustrated as having an overall uniform thickness t, height H and length L, one or more of these dimensions may be tapered and/or irregular.

In the illustrated embodiment, the edges 10-13 of the staple 100 are substantially flat. However, in other embodiments, one or more of the edges 10-13 may be shaped to provide additional tuft retention and/or decrease pressure at the bight of the bristle tuft. For example, the lateral edges 12-13 may be serrated, sharpened or barbed while the bottom edge 11 may be rounded.

The staple 100 further comprises a first major surface 20 and a second major surface 21. The second major surface 21 is opposite the first major surface 20 so that the staple 100 is a flat rectangular plate-like structure. The first major surface 20 includes a first set of grooves 30 formed into and covering the substantial entirety of the first major surface 20. All of the grooves 30 are arranged so as to be substantially parallel to one another and equidistantly spaced apart from one another. In certain embodiments, however, all of the grooves 30 may not be substantially parallel to one another and the distance between adjacent grooves may vary either irregularly or as a function of distance from one or both of the lateral edges 12-13.

As a result of the grooves 30 being spaced apart, an uninterrupted ridge 31 is formed between adjacent grooves 30. Preferably, this ridge 31 is an elongated strip and is not segmented. In other words, it is preferred that the first major surface 20 contain no grooves that intersect with one another. Stated simply, the groove pattern on the first major surface 20 is preferably free of any intersecting grooves.

The grooves 30 are linear in shape for the illustrated preferred embodiment, each extending along a groove axis B-B. In other embodiments, the grooves 30, however, may be curved, zig-zag, or an irregular shape.

The grooves 30 are preferably spaced apart from one another by a distance D of 0.29 to 0.31 millimeters, and most preferably about 0.30 millimeters. The grooves 30 preferably have a width W of 0.09 to 0.11 millimeters, and most preferably about 0.10 millimeters. In one embodiment, it is preferred that the ratio of the distance D to width W be in a range of 3.0 to 4.0, and most preferably be 3.0. The grooves 30 have a depth of 0.09 to 0.11 millimeters, and most preferably about 0.11 millimeters. The exact dimensions of the grooves and their pattern, however, can vary greatly and are not to be considered limiting of the present invention unless specifically recited in the claims. However, in one embodiment, the depth of the grooves 30 is preferably no greater than one-third of the thickness t of the staple 100. It has been discovered that making the grooves 30 having a depth greater than one-third of the thickness t results in undesired distortion of the wire/staple 100.

The grooves 30 extend the entire height 11 of the staple 100, extending from the bottom edge 11 to the top edge 10. The grooves 30 are oriented on the first major surface 20 of the staple 100 so as to be slanted with respect to the longitudinal axis A-A. Thought of another way, the groove axis B-B of each of the grooves 30 forms a non-normal angle with the longitudinal axis A-A of the staple 100. More specifically, the groove axis B-B of the grooves 30 intersect the longitudinal axis A-A at an acute angle Θ that is specially selected to provide adequate tuft retention and retain structural integrity of the staple 100 when inserted in the toothbrush. It has been surprisingly and unexpectedly discovered that the acute angle Θ plays a determining role in achieving the desired goal of increased tuft retention, depending also on the metal of construction. The angle of the groove pattern has also been discovered to allow cheaper and/or softer metals to be used without resulting in unwanted deformation and/or curling of the wire. The metal selected, however, should not be so soft that the imprinting of the groove pattern causes unwanted deformation and curling. For example, Aluminum has been discovered to be unsuitable in most cases. In one desired embodiment, a metal is selected for the staple 100 that has a Brinell hardness less than that of nickel-silver and greater than aluminum.

Through experimentation, it has been discovered that in order to create a staple 100 that performs adequately from brass, the acute angle Θ needs to be 40 to 70 degrees, more preferably 55 and 65 degrees, and most preferably about 60 degrees. When the acute angle Θ is less than 40 degrees for brass, the wire has a tendency to deform and coil. However, when the angle is greater than 70 degrees for brass, it is difficult to imprint the angled groove pattern. Furthermore, when the acute angle Θ of the groove is within the desired range, experiments using destructive testing of toothbrushes has shown that, when compared to other grooved or non-grooved anchors, tuft retention has surprisingly increased up to 25%.

The grooves 30 are oriented on the first major surface 20 as slanting upward from the bottom edge 11 to the top edge 10 going from the first lateral edge 12 to the second lateral edge 13. Of course, the grooves 30 can be arranged to slant upward in the opposite direction if desired, i.e., from the bottom edge 11 to the top edge 10 going from the second lateral edge 13 to the first lateral edge 12. The second major surface 21 of the staple 100 is preferably a smooth surface that is substantially free of grooves or other topography. In other embodiments (as will be discussed below with respect to FIGS. 7-9), the second major surface 21 may also be patterned with grooves.

The grooves 30 can be formed by roll pressing or stamping a sheet of brass with a die and then cutting the sheet into the desired strips, which are then cut to form the staples 100.

Figure 4:
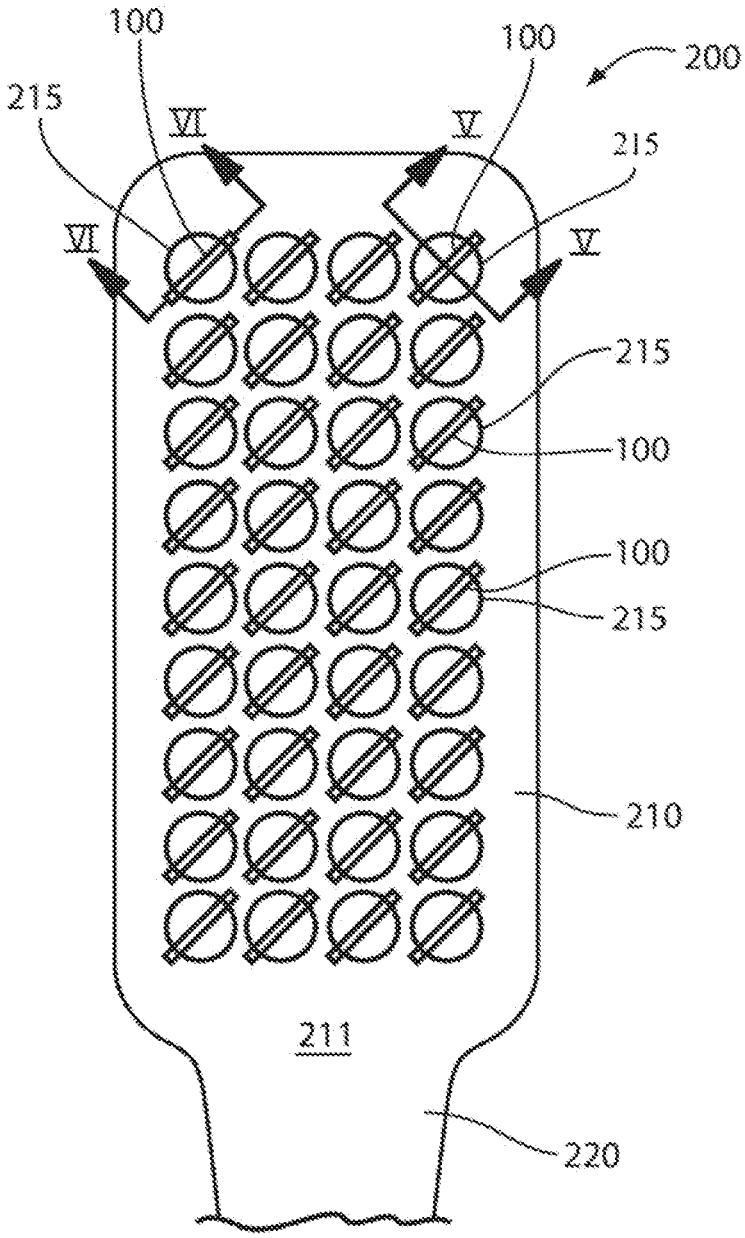
FIG. 4 is a front view of a head of a toothbrush incorporating the staples of FIG. 1 to anchor cleaning elements, which are in the form of tufts of bristles.
Figure 5:
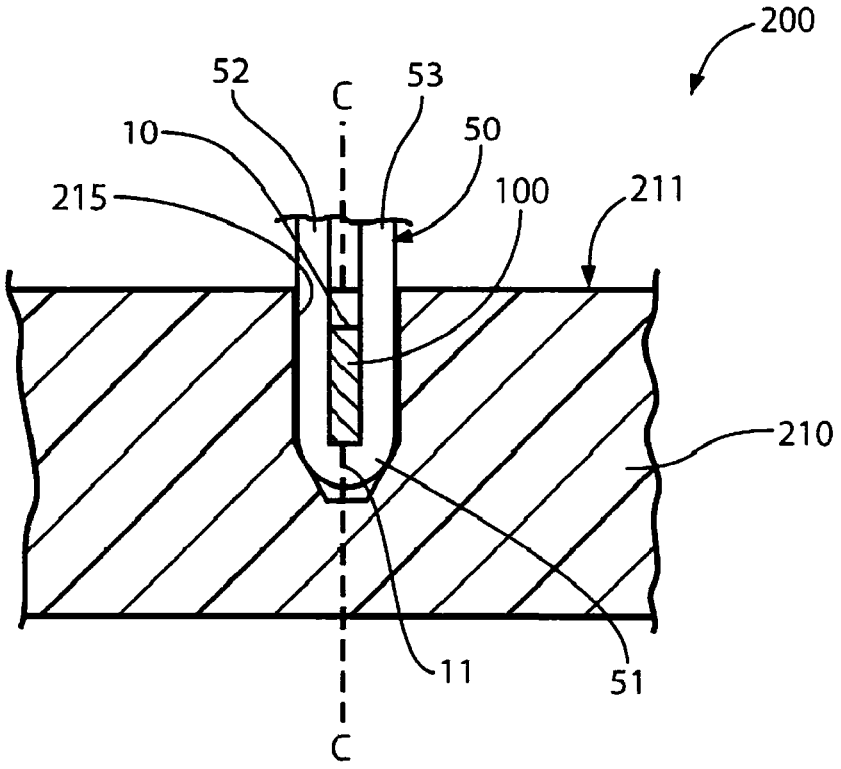
FIG. 5 is a cross-sectional view of the toothbrush head along line V-V of FIG. 4.
Figure 6:
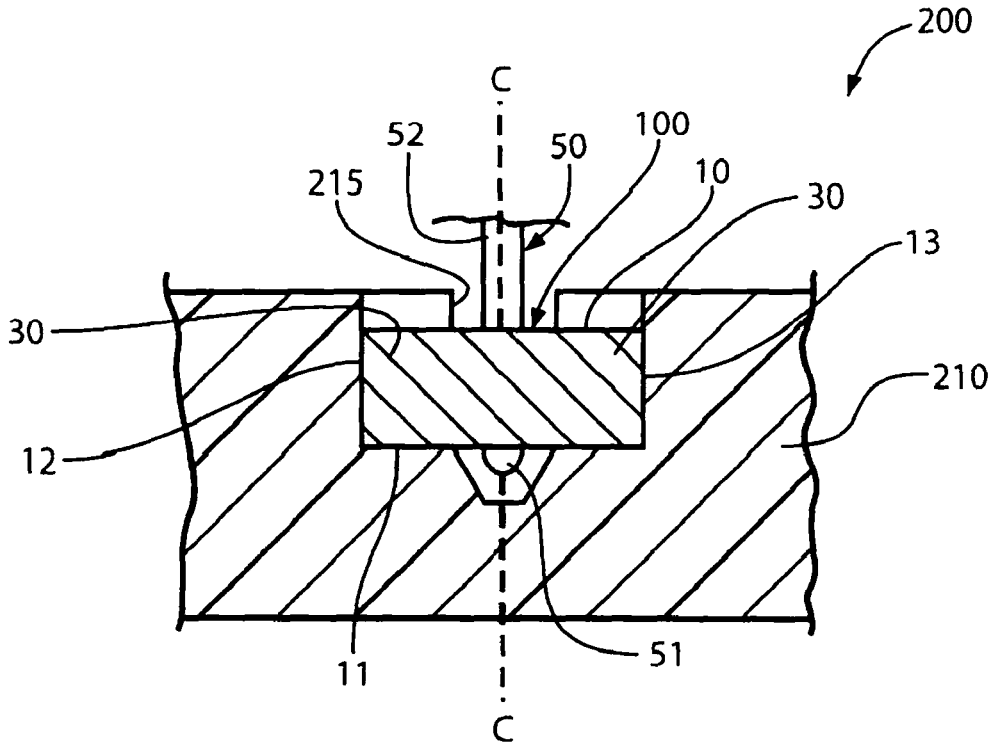
FIG. 6 is a cross-section view of the toothbrush head along line VI-VI of FIG. 4.

Referring now to FIGS. 4-6 concurrently, a toothbrush 209 is illustrated wherein each of the bristle tufts 50 are anchored in the tuft holes 215 by one of the staples 100. While bristle tufts 50 are illustrated, other cleaning elements could be used, including elastomeric fingers, fibers, etc. The toothbrush 200 comprises a head 210 and a neck portion 220 that extends into an elongated handle. A plurality of tuft holes 215 are formed into the from surface 211 of the head 210. The head 210 is typically constructed of a hard plastic, such as polypropylene.

Each of the plurality of tuft holes 215 in the toothbrush head 210 extend downwardly from the front surface 211 of the head 210 along a central axis C-C. The tuft holes 215 are preferably circular bores formed into the head 210. The tuft holes 215, of course, can be formed to be in other shapes if desired.

During manufacture, the bristle tufts 50 are bent in a U shape and secured in the tuft holes 215 by the staples 100. The staples 100 are driven into the tuft holes 215 so that each bristle tuft 50 bends in the U shape and comprises a bight portion 51 and two extending legs 52, 53. The legs 52, 53 of the bristle tufts 50 extend upward and out of the holes 215 and above the front surface 211 of the head 210. The bight or curved part 51 of the bristle tuft 50 is contacted by the bottom edge 11 of staple 100 while the two legs 52, 53 extend upwardly and define the visible bristles of the toothbrush.

The two lateral edges 12-13 of each staple 10 are seen to extend slightly into opposite sidewalls of each hole 215. The rotational orientation of the plane which contains each staple 100 is not critical, i.e., the staple 100 may be installed by rotating it, before installation, about its central vertical axis differently from the rotational orientation of about 45 degrees to assume any desired orientation. It is preferred, however, that the staples 100 be positioned in the tuft holes 215 so that the longitudinal axis A-A of the staples 100 are substantially normal to the central axis C-C of the tuft holes 21.5.

Figure 7:
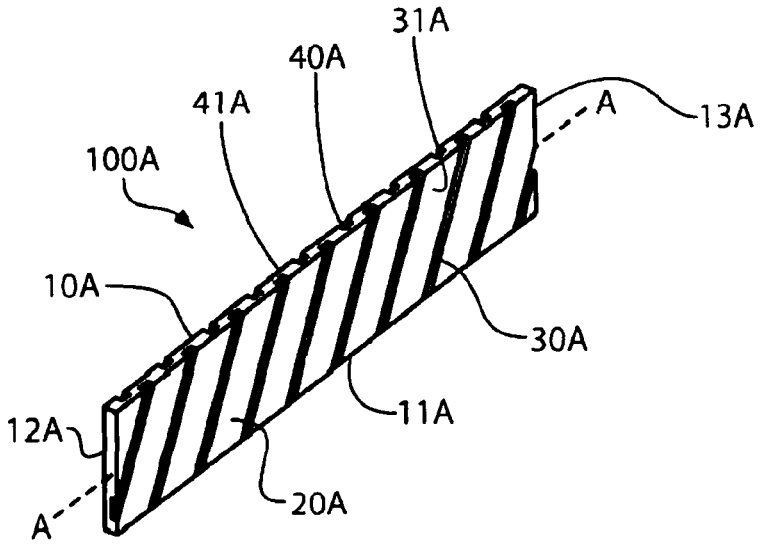
FIG. 7 is a front perspective view of a staple according to a second embodiment of the present invention.
Figure 8:
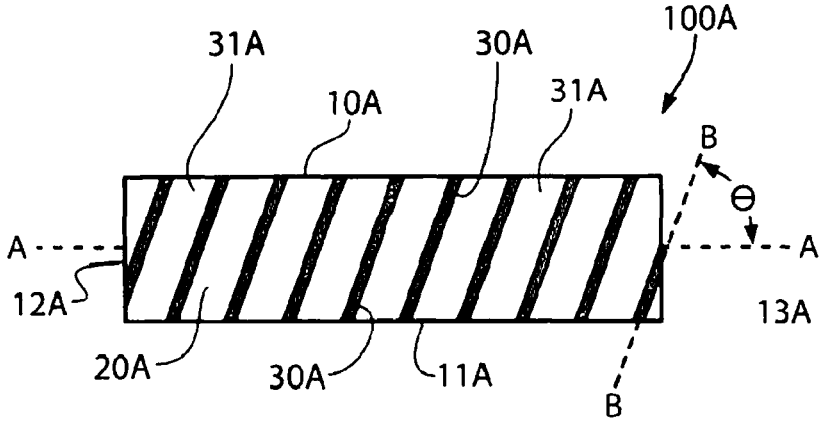
FIG. 8 is a front view of the staple of FIG. 7.
Figure 9:
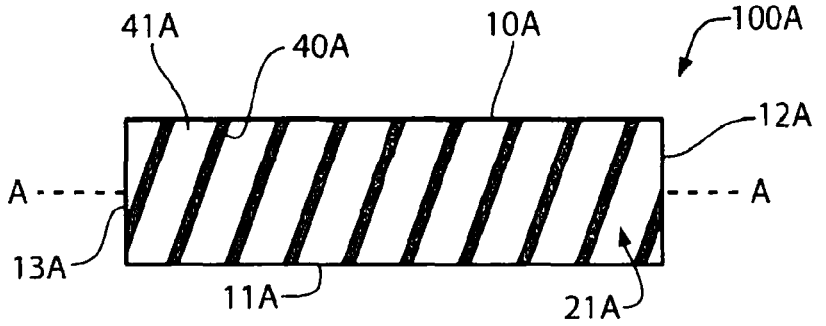
FIG. 9 is a rear view of the staple of FIG. 7.
Figure 10B:
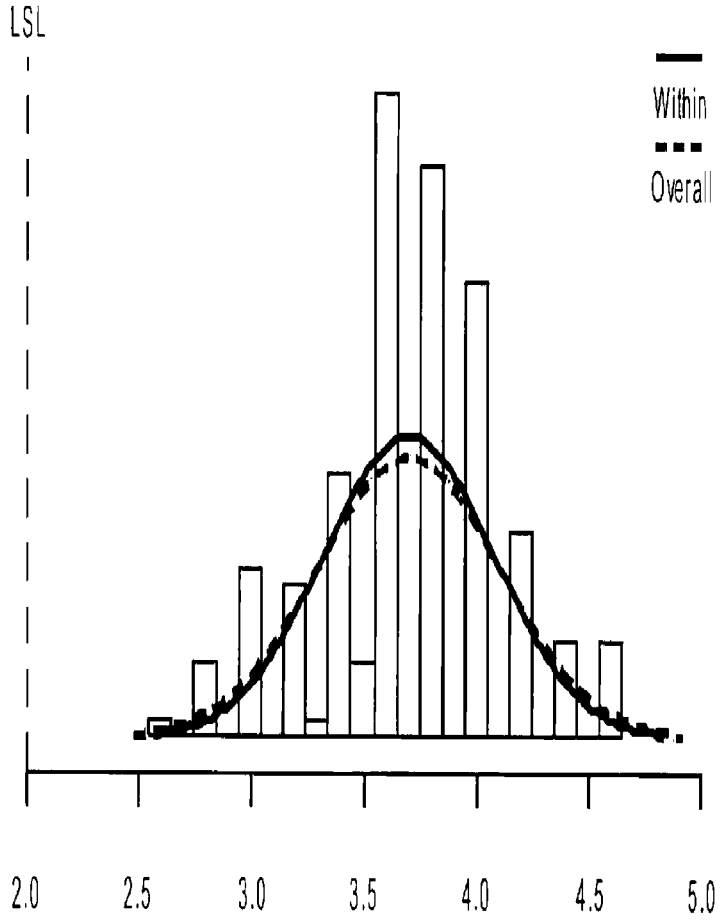
FIG. 10B is a graph of the experimental data of the table of FIG. 10A.
Figure 11B:
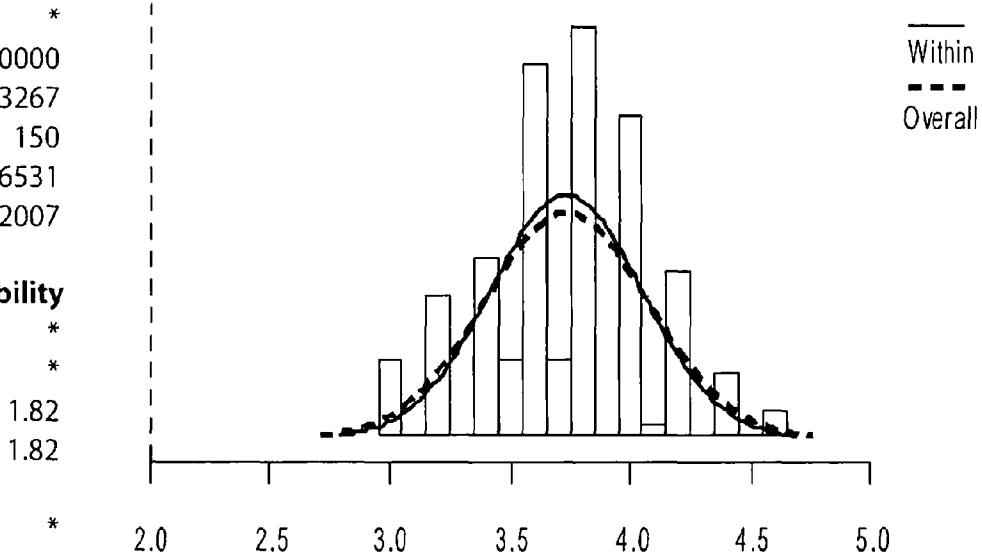
FIG. 11B is a graph of the experimental data of the table of FIG. 11A.
Figure 12B:
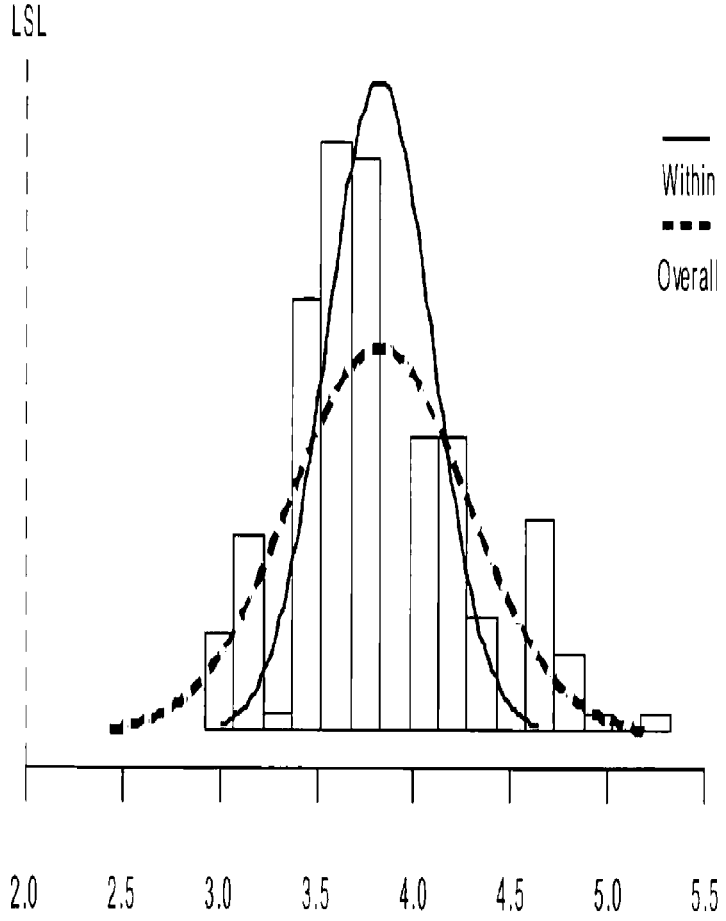
FIG. 12B is a graph of the experimental data of the table of FIG. 12A.
Figure 13B:
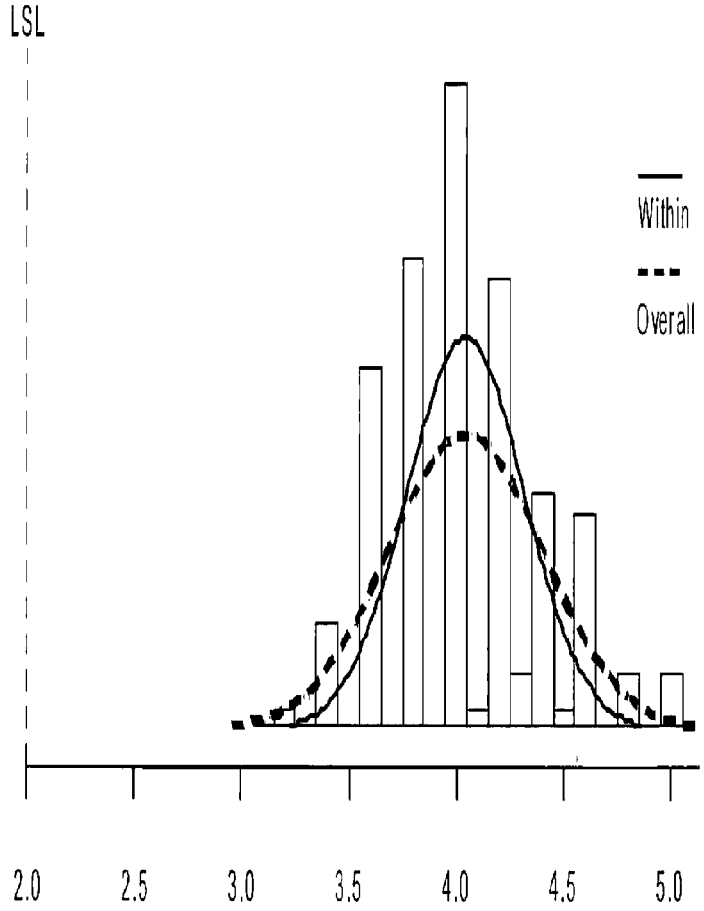
FIG. 13B is a graph of the experimental data of the table of 13A.
Figure 14B:
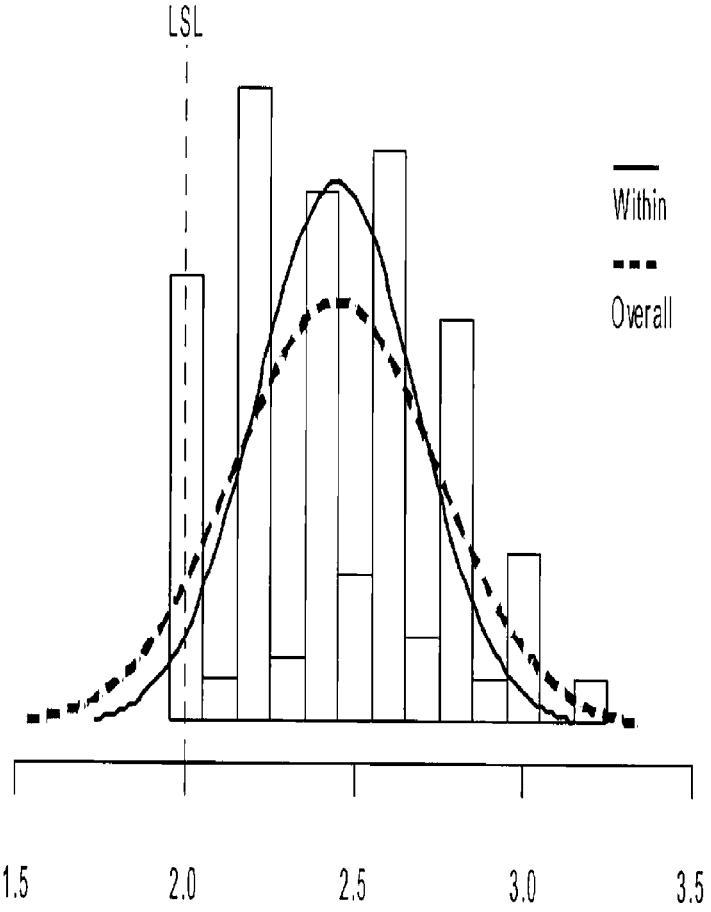
FIG. 14B is a graph of the experimental data of the table of FIG. 14A.
Figure 15B:
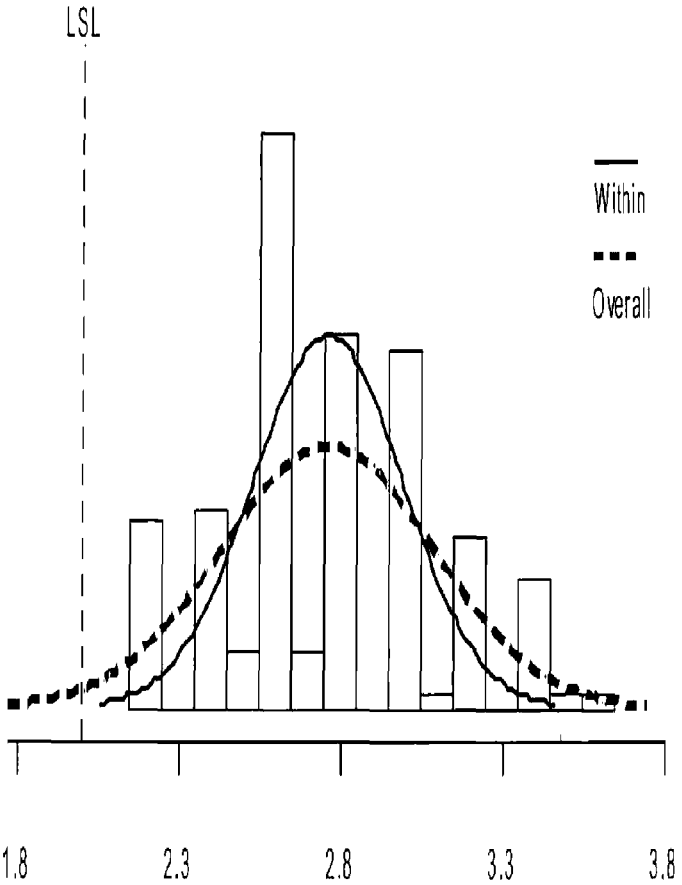
FIG. 15B is a graph of the experimental data of the table of FIG. 15A.

Referring now to FIGS. 7-9 concurrently, a staple 100A is illustrated according to a second embodiment of the invention. The basic structure of the staple 100A is identical to that of staple 100. Therefore, like numbers have been used to identify corresponding components and features with the addition of suffix "A." In order to avoid redundancy, only those features of staple 100A that are different than the staple 100 will be discussed below with the understanding; that the aforementioned discussion is applicable.

The major difference between staple 100A and staple 100 is that the second major surface 21A of the staple 100A comprises a second set of grooves 40A in addition to the first set of grooves 30A formed into the first major surface 20A. The discussion above with respect to the grooves 30 of staple 100 is generally applicable to both grooves 30A and grooves 40A, and is hereby incorporated by reference. It should be noted, however, that in this embodiment of the invention, the staple 100A is not limited to an exact range for the acute angle Θ. However, it is still preferred that the acute angle be 40 to 70 degrees.

Of note, the grooves 30A formed into the first surface 20A of the staple 100A are oriented so as to slant upward from the bottom edge 11A to the top edge 10A going from the first lateral edge 12A to the second lateral edge 13A. The grooves 40A formed into the second surface 21A of the staple 100A, however, are oriented on the second major surface 21A so as to slant upward from the bottom edge 11A to the top edge 10A going from the second lateral edge 13A to the first lateral edge 12A. In other words, the grooves 30A and the grooves 40A extend in opposing slanted directions. Of course, the orientation of the slants of the grooves 30A and the grooves 40A could be alternated. Preferably, the grooves 30A and grooves 40A are arranged so that their openings along the top and bottom edges 10A, 11A alternate along the length of the staple 100A. in the exemplified embodiment, each of the grooves 30A is spaced apart, and thus an uninterrupted ridge 31A is formed between adjacent grooves 30A. Similarly, each of the grooves 40A is spaced apart, and thus an uninterrupted ridge 41A is formed between adjacent grooves 40A.

EXPERIMENT

An experiment was conducted on three different types of commercially available toothbrushes to determine and compare the tuft retention for typical Ag—Ni staples having longitudinal grooves (i.e., 0 degrees) and brass staples having grooves angled at 60 degrees according to the present invention. The three different toothbrushes tested are referred to herein as Toothbrush 1, Toothbrush 2, and Toothbrush 3.

Referring to FIGS. 10A-11B, test data for Toothbrush 1 will be discussed. The details of the test parameters and tuft retention data for Toothbrush 1 using Ag—Ni staples having longitudinal grooves as the anchors is set forth in the table of FIG. 10A and the graph of FIG. 10B. The details of the test parameters and tuft retention data for Toothbrush 1 using brass staples having grooves angled at 60 degrees as the anchors is set forth in the table of FIG. 11A and the graph of FIG. 11B. As can be seen, for Toothbrush 1, the longitudinally grooved Ag—Ni staples resulted in an Average Tuft Retention of 3.7 kgf and a CPK of 1.5. Comparatively, the brass staples having grooves angled at 60 degrees resulted in an Average Tuft Retention of 3.7 kgf and a greater CPK of 1.82.

Referring now to FIGS. 12A-13B, test data for Toothbrush 2 will be discussed. The details of the test parameters and tuft retention data for Toothbrush 2 using Ag—Ni staples having longitudinal grooves as the anchors is set forth in the table of FIG. 12A and the graph of FIG. 12B. The details of the test parameters and tuft retention data for Toothbrush 2 using brass staples having grooves angled at 60 degrees as the anchors is set forth in the table of FIG. 13A and the graph of FIG. 13B. As can be seen, for Toothbrush 2, the longitudinally grooved Ag—Ni staples resulted in an Average Tuft Retention of 3.8 kgf and a CPK of 2.24. Comparatively, the brass staples having grooves angled at 60 degrees resulted in an improved Average Tuft Retention of 4.0 kgf and a greater CPK of 2.48.

Referring now to FIGS. 14A-15B, test data for Toothbrush 3 will be discussed. The details of the test parameters and tuft retention data for Toothbrush 3 using Ag—Ni staples having longitudinal grooves as the anchors is set forth in the table of FIG. 14A and the graph of FIG. 14B. The details of the test parameters and tuft retention data for Toothbrush 3 using brass staples having grooves angled at 60 degrees as the anchors is set forth in the table of FIG. 15A and the graph of FIG. 15B. As can be seen, for Toothbrush 3, the longitudinally grooved Ag—Ni staples resulted in an Average Tuft Retention of 2.4 kgf and a CPK of 0.63. Comparatively, the brass staples having grooves angled at 60 degrees resulted in an improved Average Tuft Retention of 2.8 kgf and a greater CPK of 1.09.

While the invention has been described and illustrated in sufficient detail that those skilled in this art can readily make and use it, various alternatives, modifications, and improvements should become readily apparent without departing from the spirit and scope of the invention.

What is claimed is:

1. A toothbrush comprising:

a handle;

a head connected to said handle and having at least one tuft hole extending into the head from a surface;

at least one tuft of bristles positioned in the tuft hole;

a staple located in the tuft hole anchoring the tuft of bristles in the tuft hole, the staple having a longitudinal axis, a first major surface, and a second major surface;

a first set of substantially parallel grooves formed into the first major surface of the staple, each of the grooves in the first set extending along a linear axis from a bottom edge of the staple to a top edge of the staple and slanting upward from a first lateral edge of the staple to a second lateral edge of the staple, the linear axis of the first set of grooves intersecting the longitudinal axis at a first acute angle; and a second set of substantially parallel grooves formed into the second major surface of the staple, each of the grooves in the second set extending along a linear axis from the bottom edge of the staple to the top edge of the staple and slanting upward from the second lateral edge of the staple to the first lateral edge of the staple, the linear axis of the second set of grooves intersection the longitudinal axis at a second acute angle; and wherein each of the grooves in the first and second sets has a width, wherein adjacent grooves in each of the first and second sets are separated by a distance, and wherein a ratio of the distance to the width is 3.0 to 4.0.

2. The toothbrush of claim 1 wherein the first acute angle is of 40 and 70 degrees and the second acute angle is of 40 and 70 degrees.

3. The toothbrush of claim 2 wherein the first and second acute angles are approximately 60 degrees.

4. The toothbrush of claim 1 wherein the grooves of the first and second sets are evenly spaced apart and cover the substantial entirety of the first and second major surfaces respectively.

* * * * *